US005287710A

United States Patent [19]

James

[11] Patent Number: 5,287,710

[45] Date of Patent: Feb. 22, 1994

[54] HINGED LOCKING MECHANISM

[76] Inventor: Paul L. James, 3217 Buford Highway, Apt. C, Atlanta, Ga. 30324

[21] Appl. No.: 927,218

[22] Filed: Aug. 10, 1992

[51] Int. Cl.[5] ..... E05B 67/12

[52] U.S. Cl. ..... 70/14; 70/43; 70/46; 70/53; 70/129; 292/148

[58] Field of Search ..... 70/2, 6, 8–10, 70/14, 27–29, 41–43, 45–47, 53–56, 129, 159–162, 166–169, 203; 292/148

[56] References Cited

U.S. PATENT DOCUMENTS

| | | | |
|---|---|---|---|
| 1,220,941 | 3/1917 | Bowers | 70/56 |
| 1,344,517 | 6/1920 | Rebsamen | 70/43 |
| 1,690,041 | 10/1928 | Sundquist | 70/53 |
| 1,766,784 | 6/1930 | Gregory | 70/43 |
| 3,563,069 | 2/1971 | Ferrer | 70/129 |
| 3,652,114 | 3/1972 | Cady et al. | 70/56 X |
| 3,953,062 | 4/1976 | Matsou | 292/57 |
| 4,085,599 | 4/1978 | Fischer et al. | 70/14 |
| 4,226,099 | 10/1980 | Garcia | 70/41 |
| 4,229,955 | 10/1980 | Coralli et al. | 70/32 |
| 4,229,956 | 10/1980 | Thornburn | 70/129 |
| 4,238,941 | 12/1980 | Halopoff | 70/56 |
| 4,307,904 | 12/1981 | Davs | 292/148 |
| 4,372,136 | 2/1983 | Mickelson | 70/14 |
| 4,372,137 | 2/1983 | Garcia | 70/41 |
| 4,372,138 | 2/1983 | De Forrest | 70/56 |
| 4,512,165 | 4/1985 | Uyeda | 70/32 |
| 4,689,975 | 9/1987 | Dunphy et al. | 70/56 |
| 4,745,783 | 5/1988 | Poe | 70/2 |
| 4,843,845 | 7/1989 | Poe | 70/54 |
| 4,873,849 | 10/1989 | Goodson et al. | 70/54 |
| 4,911,486 | 3/1990 | Anderson | 70/54 X |
| 4,949,560 | 8/1990 | Anderson | 70/54 |
| 5,036,684 | 8/1991 | Zivanovic | 70/161 |
| 5,146,771 | 9/1992 | Loughlin | 70/56 |

FOREIGN PATENT DOCUMENTS

| | | | |
|---|---|---|---|
| 81363 | 5/1895 | Fed. Rep. of Germany | 70/43 |
| 338405 | 8/1920 | Fed. Rep. of Germany | 70/55 |
| 418596 | 9/1925 | Fed. Rep. of Germany | 70/45 |
| 315625 | 7/1929 | United Kingdom | 70/43 |
| 783438 | 9/1957 | United Kingdom | 70/161 |
| 96422 | 8/1939 | Sweden | 70/43 |

OTHER PUBLICATIONS

Revolving Shackle-Guard Padlocks, McMaster-Car Supply Company 1986 Catalog, p. 676.

Shackleless Hasp Locks, McMaster-Car Supply Company 1986 Catalog, p. 678.

Stainless Steel Concealed Shackle Padlocks, McMaster-Car Supply Company 1986 Catalog, p. 675.

Shackle Protected Hardened Padlock, 1991 Sales Brochure From American Lock Company, p. 6.

*Primary Examiner*—Lloyd A. Gall

*Attorney, Agent, or Firm*—Louis T. Isaf

[57] ABSTRACT

A hinged locking mechanism for use, in its most preferred embodiment, on an existing storage door hasp assembly, which hinged locking mechanism includes a case element hinged to a frame element having two frame pins for insertion into shank apertures defined by flange members of the existing hasp assembly. The case element includes a lock and a frame cavity for selectively concealing the frame element and the flange members.

1 Claim, 7 Drawing Sheets

HINGED LOCKING MECHANISM

BACKGROUND OF THE INVENTION

The present invention relates generally to the field of locks, and in its most preferred embodiments, to the field of locking mechanisms for storage door hasp assemblies.

Prevailing increases in the cost for office and retail space and the increased mobility of families, for new jobs, etc., has caused a surge in the demand for mini warehouses and self storage facilities. Although forced entry to these units has also increased, the lessors of these units will often assume no responsibility for stored items. Furthermore, most insurance underwriters are skeptical of supplying coverage for these units, as is reflected by their deductibles and maximum coverage amounts.

Currently, a majority of storage doors are equipped with hasp assemblies which are designed to receive padlocks. One typical prior art hasp assembly includes a fixed flange and a sliding flange connected to an engaging bolt. Each flange defines two shank apertures for receiving padlock shanks to secure the hasp assembly in a bolted condition. (A representative prior art hasp assembly is shown in the accompanying drawing FIGS. 2–6.) Unfortunately, such a hasp assembly does not provide for protecting the vulnerable padlock shanks or preventing other common methods of forced entry.

SUMMARY OF THE INVENTION

Briefly described, the present invention, in its most preferred embodiment, includes a hinged locking mechanism for use on an existing storage door hasp assembly, which hinged locking mechanism includes a case element hinged to a frame element having two frame pins for insertion into shank apertures of an existing hasp assembly. The case element includes a frame cavity for selectively concealing the frame element and a lock for securing the case element around the frame element.

It is an object of the present invention to provide a more protective alternative to padlocks.

Another object of the present invention is to provide a hinged locking mechanism for use on storage door hasps.

Yet another object of the present invention is to provide a locking mechanism which encloses sliding flanges of storage door hasps.

Still another object of the present invention is to provide a hinged locking mechanism which includes a frame element having at least one frame pin and a case element for selectively concealing the frame element.

Still another object of the present invention is to provide a hinged locking mechanism which includes a locking case element hinged to a frame element having at least two frame pins.

Other objects, features and advantages of the present invention will become apparent upon reading and understanding this specification, taken in conjunction with the accompanying drawings.

DETAILED DESCRIPTION OF THE PREFERRED EMBODIMENT

Figure 1:
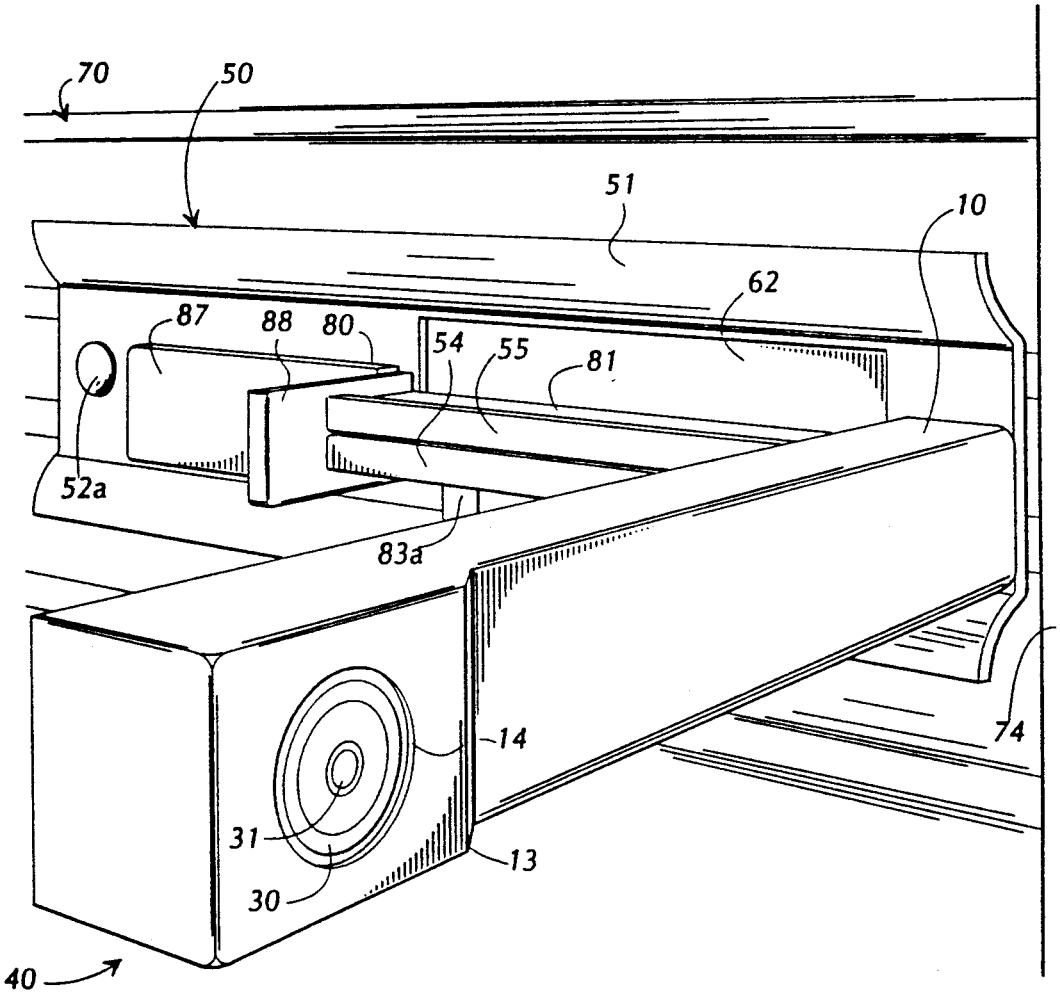
FIG. 1 is a right perspective view of a Hinged Locking Mechanism, in accordance with the preferred embodiment of the present invention, shown in an open condition on a hasp assembly.
Figure 2:
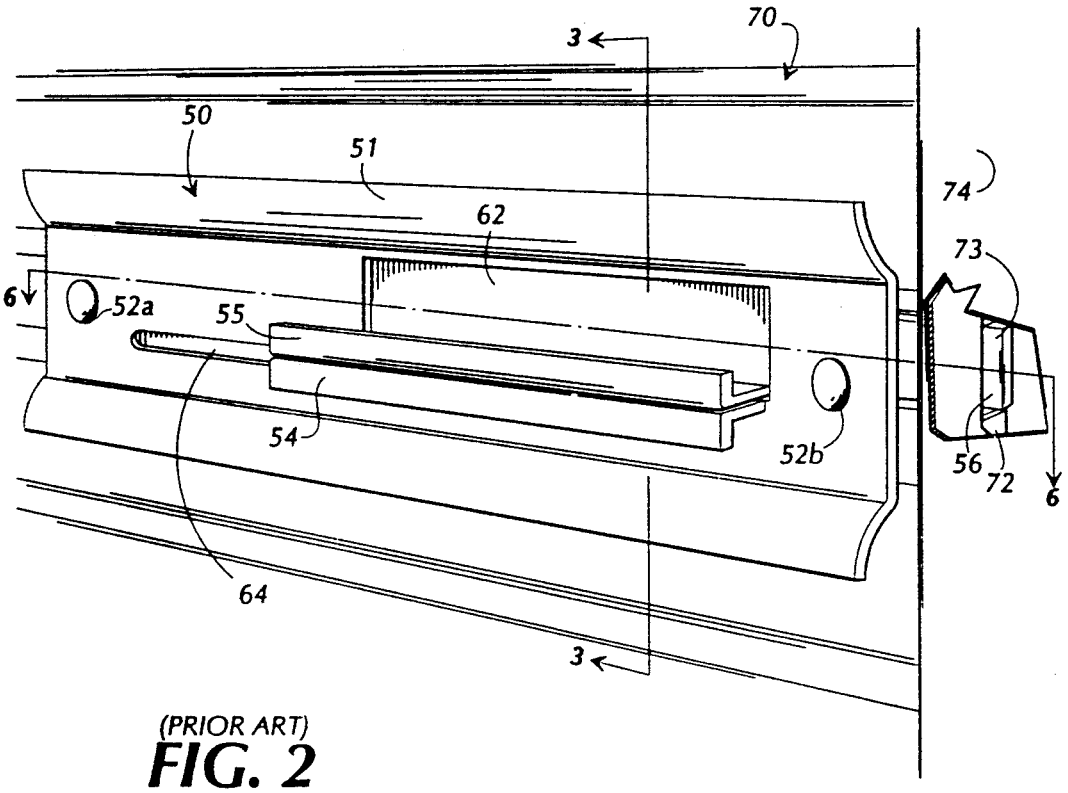
(PRIOR ART) FIG. 2
FIG. 2 is a right perspective view of the hasp of FIG. 1, shown in a bolted condition.
Figure 3:
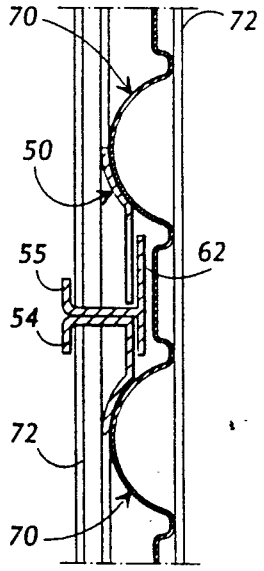
(PRIOR ART) FIG. 3
FIG. 3 is a side cross-sectional view of the hasp taken along line 3—3 of FIG. 2.

Referring now in greater detail to the drawings, in which like numerals represent like components throughout the several views, FIG. 1 shows an open Hinged Locking Mechanism 40, in accordance with the preferred embodiment of the present invention, and a hasp assembly 50 attached to a door 70.

The prior art hasp assembly 50, shown in greater detail in FIGS. 2–6, includes a hasp housing 51 fastened by fasteners 52*a,b* to the door 70, a fixed flange 54 rigidly connected to the hasp housing 51, a sliding flange 55, a flange base 62 connected to the sliding flange 55, and a flange bolt 56 connected to the flange base 62. In the bolted condition shown in FIGS. 2, 3, and 6, the flange bolt 56 occupies a track slot 73 defined in a door track 72 which provides an interface between the door 70 and a wall 74.

Figure 4:
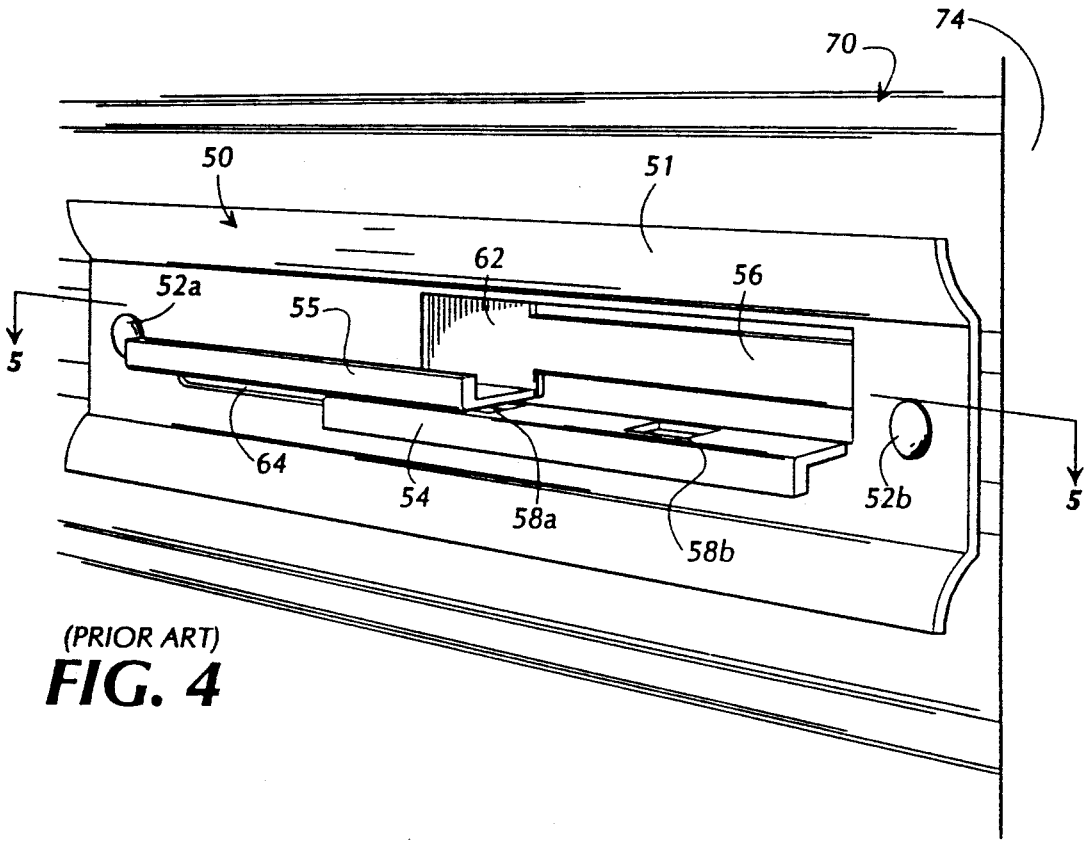
(PRIOR ART) FIG. 4
FIG. 4 is a right perspective view of the hasp in an unbolted condition.
Figure 5:
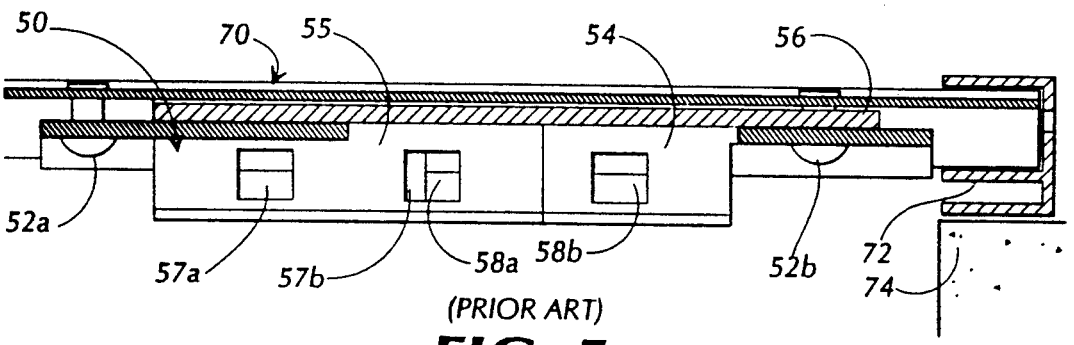
(PRIOR ART) FIG. 5
FIG. 5 is a top cross-sectional view of the hasp taken along line 5—5 of FIG. 4.
Figure 6:
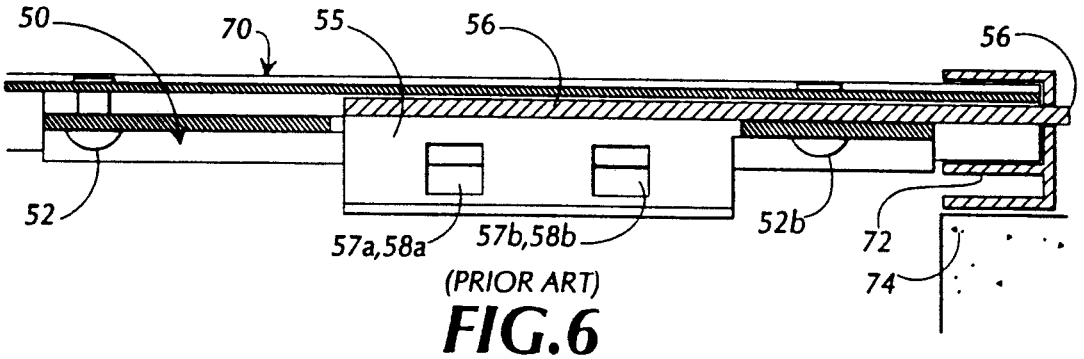
(PRIOR ART) FIG.6
FIG. 6 is a top cross-sectional view of the hasp taken along line 6—6 of FIG. 2.

The housing 51 defines a housing slit 64 through which the sliding flange 55 is slidable to the unbolted condition represented by FIGS. 4 and 5. The sliding flange 55 is shown defining two sliding flange shank apertures 57*a,b*, and the fixed flange 54 is shown defining two fixed flange shank apertures 58*a,b*. As should be clear after referring to FIGS. 2–6, the door 70 can only be opened when the hasp assembly 50 is in the unbolted condition represented by FIGS. 4 and 5. Thus, if the apertures 57*a,b* and 58*a,b* of the flanges 54, 55, respectively, are maintained in the aligned condition represented by FIGS. 2, 3, and 6, the door 70 remains bolted shut. An example of an acceptable door 70 and a hasp assembly 50 are available from Wayne-Dalton, Inc., of Dalton, Ohio.

Figure 7:
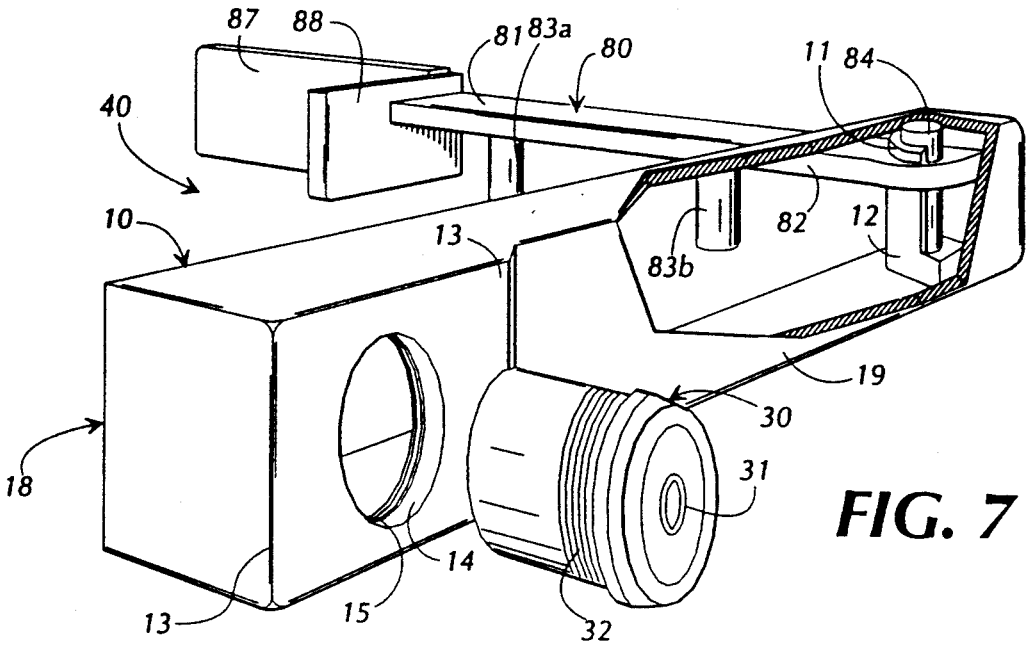
FIG. 7 is a right perspective view of the hinged locking mechanism of FIG. 1, shown with the lock exploded away from the case element and shown with a portion of the case cut away for clarity.
Figure 8:
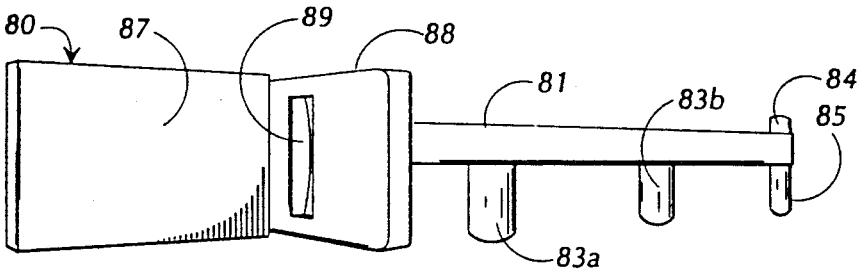
FIG. 8 is a left perspective view of the frame element of FIG. 7.
Figure 9:
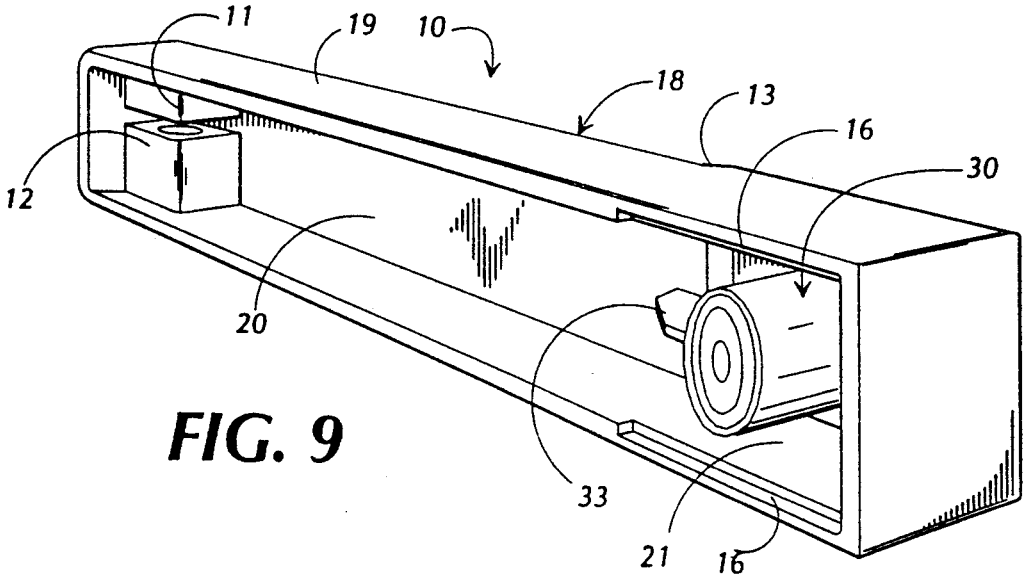
FIG. 9 is a right rear perspective of the case element of FIG. 7.

The hinged locking mechanism 40, in accordance with the preferred embodiment of the present invention, is shown in greater detail in FIGS. 7–9. In FIG. 7, a case element 10 is shown attached to a frame element 80. In the preferred embodiment of the present invention, the frame element 80 and the case element 10 are constructed of hard, machinable stainless steel. Referring also to FIG. 8, which shows an isolated view of the frame element 80, a frame bar 81 is shown supporting an upper hinge pin 84, a lower hinge pin 85, and two frame pins 83*a,b*. A striker plate 88 is shown transversely connected to one end of the frame bar 81 and defining in an outer side a striker recess 89. A back plate 87 is shown connected to a back end of the outer side of the striker plate 88.

Referring now to FIGS. 7 and 9, the case element 10 is shown including a case housing 18 which includes a bar housing section 19 and a lock housing section 13. The bar housing section 19 is shown defining a bar cavity 20, within which is shown located an upper hinge base 11 and a lower hinge base 12. The lock housing section 13 of the case housing 18 is shown defining a lock cavity 21, a lock face recess 14, a threaded passage 15, and a back plate indent 16. A key lock 30 is shown including a keyway 31, lock threads 32, and a retractable lock bolt 33. One example of an acceptable key lock 30 is available from Baton Lock & Hardware of Garden Grove, CA.

According to the preferred embodiment of the present invention, the case element 10 of the hinged locking mechanism 40 is first constructed without the upper and lower hinge bases 11, 12 which are formed separately. The upper and lower hinge bases 11, 12 are first placed on the upper and lower hinge pins 84, 85, respectively, and then flash welded into the bar cavity 20 of the case element 10, as shown in FIG. 7. Such welding effectively hinges the case element 10 to the frame element 80 (the pins 84,85 and bases 11,12 forming a hinge) so that the hinged locking mechanism 20 is movable between an open condition and a closed condition. The key lock 30 is subsequently screwed into the threaded passage 15, as shown in FIG. 9.

Figure 10:
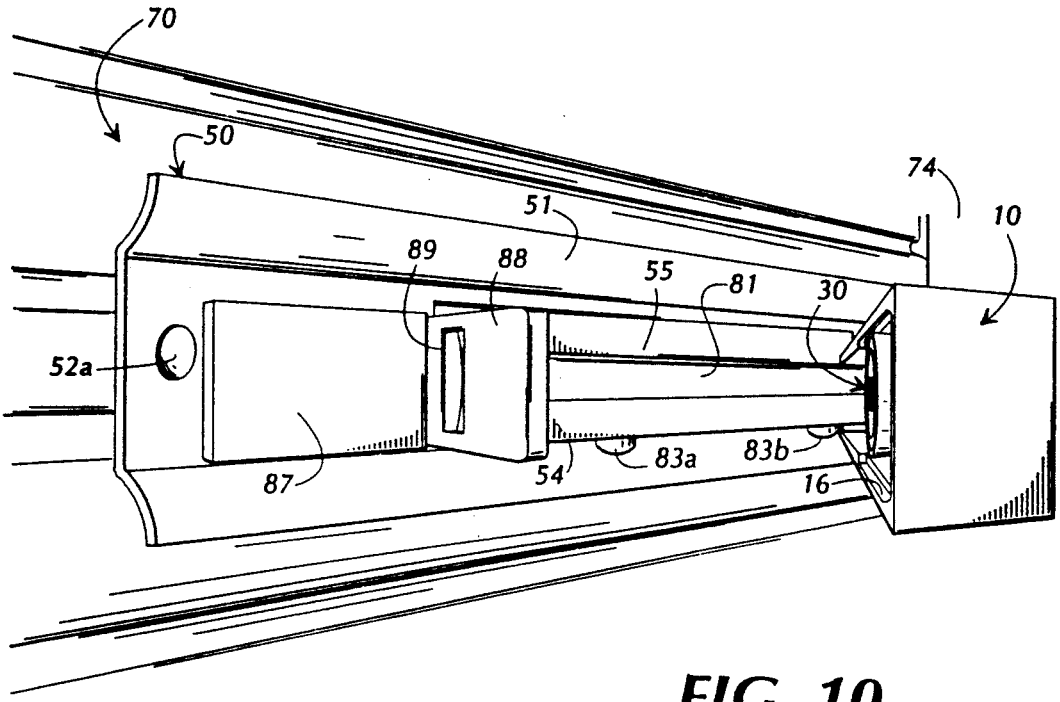
FIG. 10 is a left perspective view of the elements of FIG. 1.

During use of the preferred embodiment of the present invention, the hinged locking mechanism 40 is attached to the hasp assembly 50 as shown in FIG. 10. In other words, the frame pins 83*a,b* are dropped down into the aligned apertures 57*a*, 58*a*, and 57*b*, 58*b*, respectively, (FIG. 6) so that the frame bar 81 rests on the sliding flange 55 and the back plate 87 covers the housing slit 64. In such an arrangement, the frame pins 83*a,b* prevent the sliding flange 55 from sliding relative to the fixed flange 54, thus maintaining the hasp assembly 50 in a bolted condition.

Figure 11:
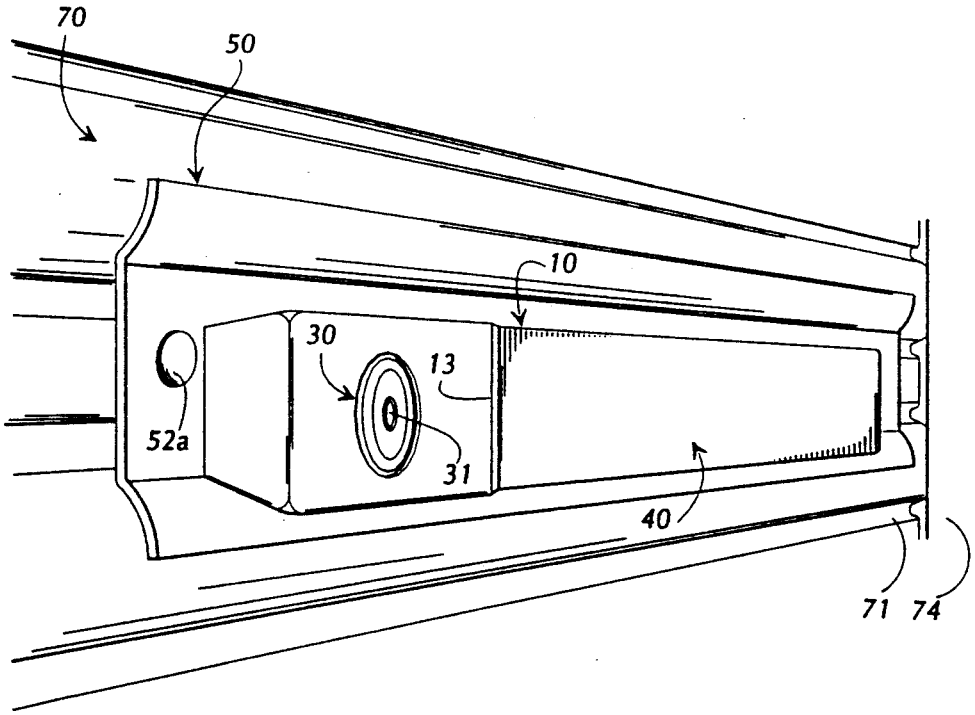
FIG. 11 is a left perspective view of the elements of FIG. 10, showing the hinged locking mechanism in a closed condition.
Figure 13:
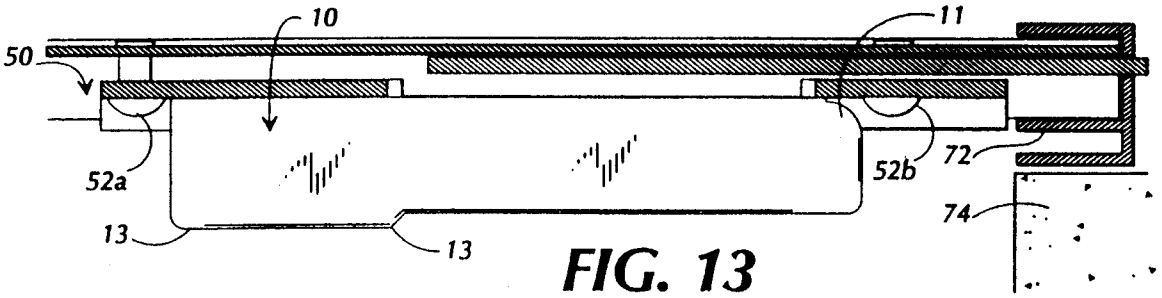
FIG. 13 is a top cross-sectional view of the elements of FIG. 12, taken along line 13—13 of FIG. 12.
Figure 12:
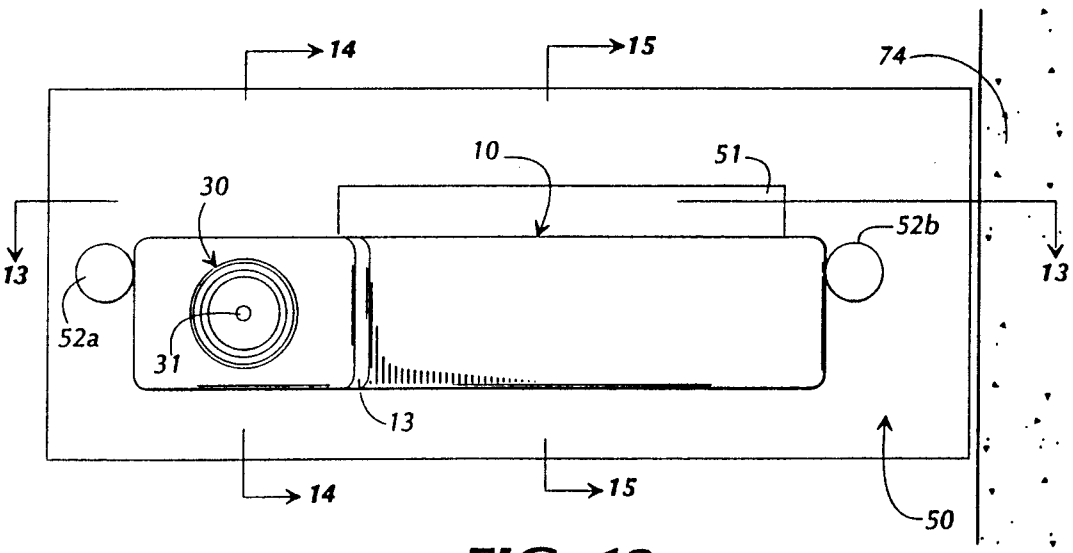
FIG. 12 is a front view of the elements of FIG. 11.
Figure 14:
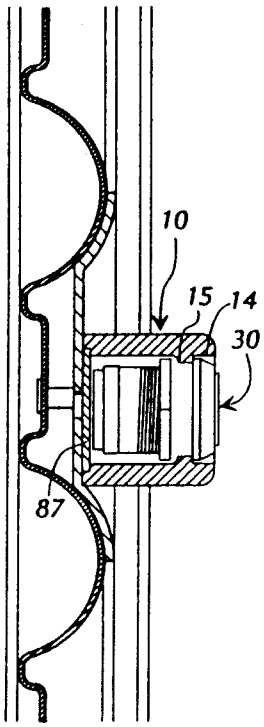
FIG. 14 is a side cross-sectional view of the elements of FIG. 12, taken along line 14—14 of FIG. 12.
Figure 15:
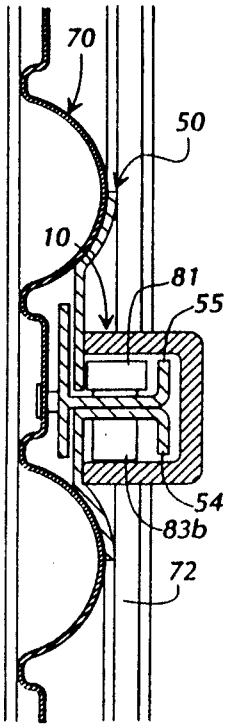
FIG. 15 is a side cross-sectional view of the elements of FIG. 12, taken along line 15—15 of FIG. 12.
Figure 17:
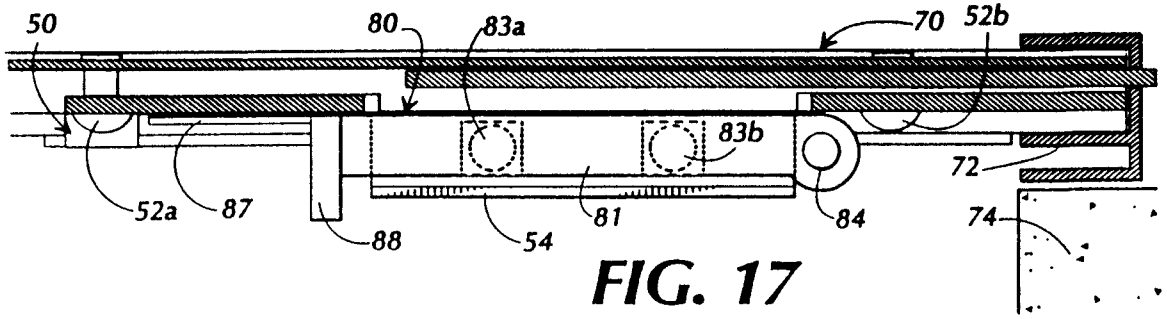
FIG. 17 is a top cross-sectional view of the elements of FIG. 16, taken along line 17—17 of FIG. 16.
Figure 16:
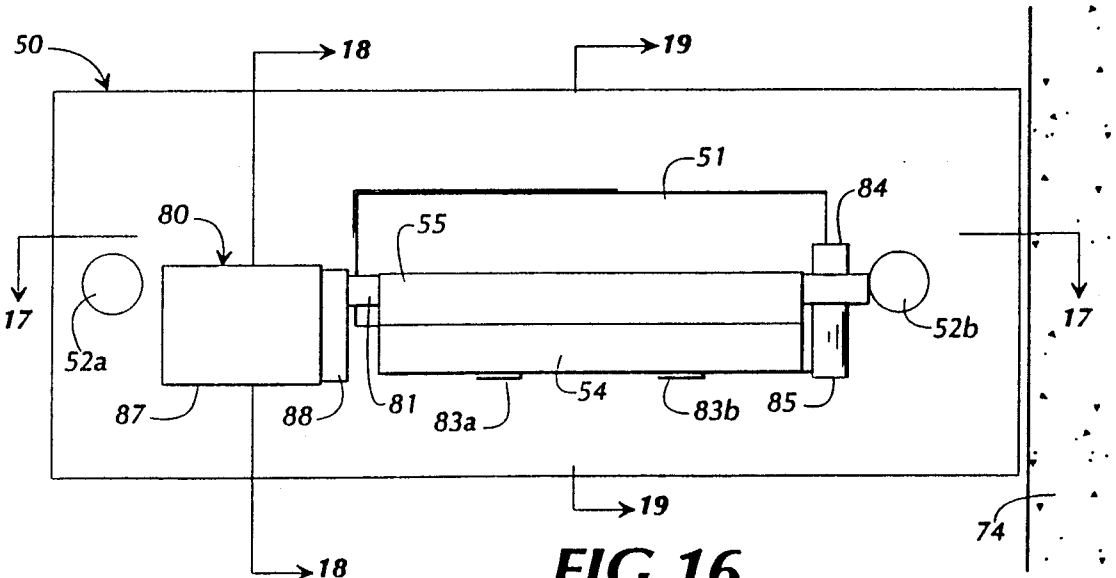
FIG. 16 is a front view of the elements of FIG. 12, shown without the case element.
Figure 19:
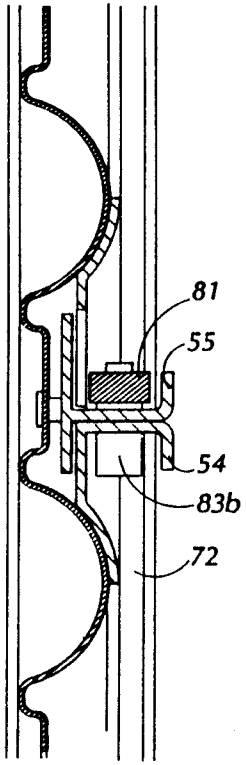
FIG. 19 is a side cross-sectional view of the elements of FIG. 16, taken along line 19—19 of FIG. 16.
Figure 18:
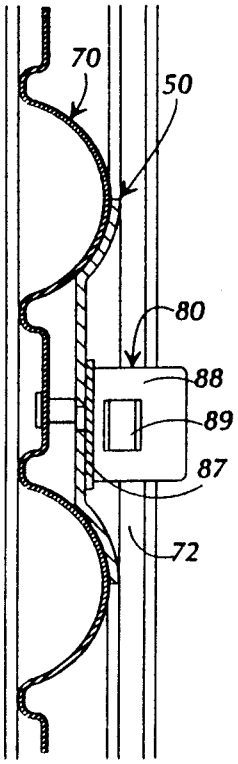
FIG. 18 is a side cross-sectional view of the elements of FIG. 16, taken along line 18—18 of FIG. 16.

The case element 10 is then pivoted around the hinge created by the pins 84,85 and bases 11,12 until the flanges 54,55, the frame bar 81, and frame pins 83 are enclosed within the bar cavity 20 of the bar housing section 19 and the striker plate 88 and back plate 87 are enclosed within the lock cavity 21 of the lock housing section 13 (FIG. 11). The key lock 30 is then manipulated to cause the lock bolt 33 to extend into the striker recess 89 to lock the hinged locking mechanism 40 in the closed condition and prevent removal of the key lock 30.

While the hinged locking mechanism 40 is in the closed condition, internal access to the key lock 30 is prevented by the lock housing section 13, the back plate 87, and the striker plate 88. With the frame pins 83*a,b* located within the apertures 57*a,b* and 58*a,b*, and the hinged locking mechanism 40 in the closed condition, access to the frame pins 83*a,b* and flanges 54,55 is prevented by the bar housing section 19 which is held close to the hasp housing 51.

The hinged locking mechanism 40 is unlocked, opened, and removed from the hasp assembly through reversing the above steps. FIGS. 12–15 show additional views of the condition shown in FIG. 11, and FIGS. 16–19 show similar views without the case element 10.

It should be understood that the present invention includes other alternately shaped embodiments of locking mechanisms with one or more pins for various other uses, including any application wherein a padlock could normally be utilized, such as, without limitation, connecting ends of a chain, securing a locker door, preventing an ordinary hasp from separating from a staple, securing alternately shaped sliding door hasps, etc.

While the embodiments of the present invention which have been disclosed herein are the preferred forms, other embodiments of the apparatus of the present invention will suggest themselves to persons skilled in the art in view of this disclosure. Therefore, it will be understood that variations and modifications can be effected within the spirit and scope of the invention and that the scope of the present invention should only be limited by the claims below.

I claim:

1. A locking apparatus for use on a hasp assembly having at least one hasp flange member defining a first shank aperture and a second shank aperture, said locking apparatus comprising:

a frame element including, at least, a frame bar, a first hinge pin extending in a first direction away from a first side of said frame bar, a second hinge pin extending in a second direction away from a second side of said frame bar, a first frame pin extending transversely away from said first side of said frame bar for insertion into the first shank aperture, a second frame pin extending transversely away from said first side of said frame bar for insertion into the second shank aperture; and a case element hinged to said frame element defining a frame cavity for receipt of said frame element and at least one hasp flange member and including, at least, a first hinge pin base means for receiving said first hinge pin, a second hinge pin base means for receiving said second hinge pin, a locking means for securing said case element around said frame bar and the flange member, said locking means including, at least, a cylinder lock including, at least, a retractably locking bolt.

* * * * *